US012662781B2

(12) United States Patent
Shao et al.

(10) Patent No.: US 12,662,781 B2
(45) Date of Patent: Jun. 23, 2026

(54) COMPOSITE DECK STRUCTURE FOR BRIDGE AND BRIDGE STRUCTURE AND CONSTRUCTION METHOD THEREOF

(71) Applicant: HUNAN UNIVERSITY, Changsha (CN)

(72) Inventors: Xudong Shao, Changsha (CN); Xuan Sun, Changsha (CN); Junhui Cao, Changsha (CN); Deqiang Zou, Changsha (CN); Weidong Li, Changsha (CN)

(73) Assignee: HUNAN UNIVERSITY, Changsha (CN)

( * ) Notice: Subject to any disclaimer, the term of this patent is extended or adjusted under 35 U.S.C. 154(b) by 582 days.

(21) Appl. No.: 18/319,713

(22) Filed: May 18, 2023

(65) Prior Publication Data

US 2023/0287640 A1 Sep. 14, 2023

Related U.S. Application Data

(63) Continuation of application No. PCT/CN2022/078702, filed on Mar. 2, 2022.

(30) Foreign Application Priority Data

Mar. 12, 2021 (CN) ..... 202110269196.4

(51) Int. Cl.
*E01D 2/02* (2006.01)
*E01D 2/04* (2006.01)
(Continued)

(52) U.S. Cl.
CPC ..... *E01D 2/02* (2013.01); *E01D 2/04* (2013.01); *E01D 19/125* (2013.01); *E01D 21/00* (2013.01);
(Continued)

(58) Field of Classification Search
CPC ..... E01D 2/02; E01D 2/04; E01D 19/125; E01D 21/00; E01D 2101/268; E01D 2101/30
See application file for complete search history.

(56) References Cited

U.S. PATENT DOCUMENTS 3,302,361 A * 2/1967 Oudheusden, Jr. ... E01D 19/125 52/798.1
4,831,675 A * 5/1989 Nedelcu ..... E01D 19/125 14/73
(Continued)

FOREIGN PATENT DOCUMENTS

CN 106980675 A 7/2017
CN 106948262 B * 10/2018 ..... E01D 19/125
(Continued)

*Primary Examiner* — Abigail A Risic
(74) *Attorney, Agent, or Firm* — Nitin Kaushik

(57) ABSTRACT

A composite deck structure for a bridge, and a bridge structure and a construction method thereof. The composite deck structure includes a top plate (1), longitudinal ribs (2), and transverse ribs (3), the longitudinal ribs (2) are fixedly connected to the transverse ribs (3), and are connected to the diaphragms (4) by means of the transverse ribs (3), and the transverse ribs (3) are not provided with cutouts for accommodating the longitudinal ribs (2). According to the composite deck structure, no cutout is provided on the diaphragms (4), and stress generated by the cutouts is reduced; hot-rolled section steel is used for longitudinal ribs (2) and transverse ribs (3) instead of welded steel plates, such that welding seams are reduced and fatigue resistance of the composite deck structure is improved.

8 Claims, 6 Drawing Sheets

(51) Int. Cl.

| | |
|---|---|
| ***E01D 19/12*** | (2006.01) |
| ***E01D 21/00*** | (2006.01) |
| *E01D 101/26* | (2006.01) |
| *E01D 101/30* | (2006.01) |

(52) U.S. Cl.
CPC .... *E01D 2101/268* (2013.01); *E01D 2101/30* (2013.01)

(56) References Cited

U.S. PATENT DOCUMENTS

| | | | | |
|---|---|---|---|---|
| 2007/0000077 | A1* | 1/2007 | Wilson | E01D 19/125 14/73 |
| 2009/0077758 | A1* | 3/2009 | Vincent | E01D 22/00 14/73 |

FOREIGN PATENT DOCUMENTS

| | | | | | |
|---|---|---|---|---|---|
| CN | 109281248 | A | * | 1/2019 | E01D 19/125 |
| CN | 109797663 | A | | 5/2019 | |
| CN | 111139746 | A | * | 5/2020 | E01D 19/12 |
| CN | 211472172 | U | * | 9/2020 | |
| CN | 112747877 | A | | 5/2021 | |

* cited by examiner

COMPOSITE DECK STRUCTURE FOR BRIDGE AND BRIDGE STRUCTURE AND CONSTRUCTION METHOD THEREOF

CROSS-REFERENCE TO RELATED APPLICATIONS

The application claims priority to Chinese patent application No. 2021102691964, filed on Mar. 12, 2021, the entire contents of which are incorporated herein by reference.

TECHNICAL FIELD

The present disclosure relates to the field of bridge engineering, and particularly relates to a composite deck structure for a bridge, and a bridge structure and a construction method thereof.

BACKGROUND

Orthotropic steel deck (OSD) has the advantages of light weight, high strength and convenient construction, which has been widely used in steel bridges, especially in long-span steel bridges. The conventional OSD consists of a steel panel, longitudinal stiffening ribs, and diaphragms. The longitudinal ribs and the diaphragms in the steel deck are welded to each other and all welded to the steel panel. The conventional OSD has a complex structure and large number of welding seams. Due to its complex geometric structure, the steel processing workload are relatively larger. In addition, the influence of local secondary stress and deformation caused by welding makes OSD more susceptible to fatigue. When a heavy-duty vehicle repeatedly runs on a welded steel structure, the steel deck at a welding seam is highly likely to produce a fatigue crack. The crack will gradually evolve into a macroscopic crack, which will cause fracture of the welded steel structure in severe cases.

Fatigue cracking of steel decks, a global problem in the field of steel bridges, has been a major technical bottleneck in the development of steel bridges. Many OSDs have experienced severe fatigue cracking problems under wheel loads within 10-20 years, which is far less than 100 years of service life. The fatigue strength caused by wheel loads, rather than ultimate strength, controls the design and construction of OSD. For a long time, the maintenance and reinforcement cost of steel bridges is so high that not only huge national economic losses but also an indelible negative impact on society are caused.

SUMMARY

The present disclosure provides an innovative composite deck structure for the steel bridge and a construction method thereof, so as to solve technical problems that the conventional OSD has complex structure and too many welding seams and is prone to fatigue cracks.

To solve the above technical problems, the present disclosure employs the following technical solutions.

A composite deck structure for a bridge includes a top plate and longitudinal ribs fixed to a lower surface of the top plate, and further includes transverse ribs spliced on diaphragms of a main beam structure of a bridge. The longitudinal ribs are fixedly connected to the transverse ribs, and are connected to the diaphragms by means of the transverse ribs. The diaphragms are not provided with cutouts for accommodating the longitudinal ribs.

According to a design idea of the technical solution, in the prior art, longitudinal ribs of a conventional OSD need to penetrate diaphragms and be welded, so the diaphragms need to be provided with cutouts for accommodating and welding the longitudinal ribs during construction, but welding seams at intersections of the longitudinal ribs and the diaphragms and the cutouts of the diaphragms have large fatigue stress, which lead to fatigue cracks of the steel deck. According to the present disclosure, one transverse rib spliced on the diaphragm is directly connected to the longitudinal rib, and the longitudinal rib is fixedly connected to the transverse rib and diaphragm by not providing the cutouts, such that excessive stress caused by the cutouts is avoided, a steel fatigue phenomenon of the deck structure is alleviated, the service life of the deck structure is prolonged, and safety performance of the deck structure is improved.

As a further improvement to the technical solution:

The longitudinal ribs and the transverse ribs are made of hot-rolled section steel commercially available on the market. By selecting the hot-rolled section steel commercially available on the market as the longitudinal ribs and the transverse ribs, the preferred solution has the two following technical effects. Firstly, existing longitudinal ribs are generally manufactured by splicing and cutting steel plates on site, and thus have many welding seams and machining positions and have concentrated stress; welding is not required by using the hot-rolled section steel, such that the number of welding seams is decreased; and the one-piece hot-rolled section steel base material itself has much greater fatigue resistance than the welding steel plates; and the hot-rolled section steel is arranged in a high-stress zone of a deck, such that risk sources of fatigue cracking caused by welding and machining can be significantly reduced. Secondly, the hot-rolled section steel is a common material in engineering, it is only necessary to cut different lengths according to structural requirements of a main beam during production of the longitudinal ribs and the transverse ribs, and no extra rolling, bending, opening and welding are required for the hot-rolled section steel, such that machining procedures are reduced, construction cost is reduced, and manufacturing convenience is greatly enhanced. Meanwhile, the hot-rolled section steel is widely available and has low cost, such that material cost can be obviously reduced.

The longitudinal rib includes a longitudinal web plate and a longitudinal flange plate. The transverse rib includes a transverse web plate and a transverse flange plate. The longitudinal rib is fixedly connected to the transverse rib by means of contact surfaces of the longitudinal flange plate and the transverse flange plate. According to the preferred solution, specific structures of the longitudinal ribs and the transverse ribs are limited, the hot-rolled section steel including at least one flange plate is used as a material of each of the longitudinal ribs and transverse ribs, and the longitudinal rib is fixedly connected to the transverse rib by connecting the two flange plates, such that fixed-connection positions or a fixed-connection area can be increased, and further fixing is more stable.

The longitudinal ribs are located on the transverse ribs. Stress of a vehicle load on a deck is dispersed through upper ultra-high-performance concrete and the longitudinal ribs, the longitudinal ribs are connected to the transverse ribs by enabling the flange plates having a large area to make contact with each other and bear pressure, and a connection structure between the flange plates is located in a low-stress zone at an edge of the flange plates. Such a connection method can significantly reduce stress at joints.

The longitudinal ribs and the transverse ribs are made of one of H-shaped steel, angle steel, I-shaped steel, and T-shaped steel. The above three types of hot-rolled section steel are common and easily available, and satisfy relevant requirements of the above technical solution for the flange plates. Use of the above hot-rolled section steel can significantly reduce material cost, construction difficulty, and construction cost.

A central axis of the transverse web plate is flush with a central axis of the diaphragms in the main beam structure of the bridge in a vertical direction.

Both the longitudinal flange plate and the transverse flange plate have a width greater than or equal to 100 mm. Limitation on the width of the flange plates can ensure a contact stress area between the longitudinal ribs and the transverse ribs, and ensure welding connection strength of the welding seams between the longitudinal ribs and the transverse ribs (herein, a welding length of the welding seams is equal to a width of the flange plates).

The web plate of the longitudinal rib has a thickness greater than or equal to 6 min. The web plate of the transverse rib has a thickness greater than or equal to 8 mm. The thickness of the web plates is determined according to an empirical thickness in existing bridge engineering, and a minimum thickness determined by the inventor according to many studies and repeated experiments can ensure that the bridge structure satisfies stress requirements.

The longitudinal ribs have a height smaller than or equal to 800 mm, and the transverse ribs have a height smaller than or equal to 400 mm.

The longitudinal ribs are arranged on the lower surface of the top plate at intervals, and an lateral spacing between two adjacent longitudinal ribs is 300 mm-800 mm.

The top plate is a composite plate. The composite plate includes the steel panel and an ultra-high-performance concrete layer poured on the surface of the steel panel. Studs are welded on the top surface of the steel panel. The studs have a diameter of 10 mm-30 mm and a height of 25 mm-65 mm. The diameter and the height of the studs are specified to satisfy connection between the steel panel and the ultra-high-performance concrete poured on the steel panel, and further satisfy structural requirements. The value range is a rational value interval limited by the inventor according to existing research results.

A single layer of criss-crossed reinforced steel mesh is arranged in the ultra-high-performance concrete layer, and transverse steel bars are located above longitudinal steel bars. Transverse steel bars and longitudinal steel bars have a diameter of 8 mm-20 mm. An interval between the adjacent longitudinal steel bars and an interval between the adjacent transverse steel bars are both 15 mm-300 mm.

The ultra-high-performance concrete refers to concrete containing steel fibers and having compressive strength not smaller than 100 MPa and axial tensile strength not smaller than 7 MPa.

The steel panel is a flat plate having a thickness of 6 mm-20 mm. The ultra-high-performance concrete plate is a uniform-thickness plate, and has a thickness of 30 mm-100 mm.

The longitudinal ribs are connected to the steel panel through welding. The longitudinal flange plates of the longitudinal ribs are connected to the transverse flange plates of the transverse ribs through welding or bolting. The transverse ribs are connected to the diaphragms through welding.

A bridge structure including the composite deck structure according to the above technical solutions includes a composite deck structure and a main beam structure. The main beam structure is a steel box beam, a steel truss beam, or a steel plate beam. The main beam structure includes diaphragms. The composite deck structure is fixed onto a main beam. Transverse ribs are spliced on the diaphragms of the main beam structure.

As a further improvement to the technical solution:

The diaphragms are arranged at intervals in the main beam structure, and an interval between two adjacent diaphragms is 2.5 m-8 m. In order to satisfy stress of the entire bridge, the interval is determined by the inventor according to a general bridge engineering empirical value range.

A construction method of the bridge structure according to the above technical solution includes the following steps:

S1, in a factory prefabrication workshop, the steel panel is placed at a bottom layer, and the longitudinal ribs are welded onto the steel panel; and steel beam segments including the diaphragms below a deck are also prefabricated in a factory;

S2, the transverse ribs are fixedly connected to the longitudinal ribs, so as to form an orthogonal composite deck unit;

S3, after the orthogonal composite deck unit is overturned, the transverse ribs of the orthogonal composite deck unit are correspondingly welded to the diaphragms of the steel beam segments, so as to form main steel beam segments of an entire bridge;

S4, the studs are welded to the steel panel after the main steel beam segments are transported to a bridge construction site and spliced into a full-length main beam segment by segment, a reinforced steel mesh is arranged, and ultra-high-performance concrete is poured on site, so as to finally form a complete bridge structure.

According to a design idea of the above technical solution, through a unique design of the deck structure of the present disclosure, steps of machining the longitudinal ribs and the diaphragms on site in the prior art can be reduced, a bridge deck welding operation can be reduced, raw materials are common, easily available and low in cost, and construction cost can be significantly reduced.

Compared with the prior art, the present disclosure has the following advantages:

(1) According to the present disclosure, the longitudinal ribs are connected to the diaphragms by means of the transverse ribs, such that an operation of providing the cutouts on the diaphragms in the prior art is avoided, and stress generated by the cutouts is reduced; the longitudinal ribs and the transverse ribs of the deck are made of the hot-rolled section steel instead of the welded steel plate, such that the welding seams are reduced; and the hot-rolled section steel is placed in the high-stress zone, and the welding seams are provided in the low-stress zone, such that the fatigue resistance of the composite deck structure is improved.

(2) The bridge structure of the present disclosure is very economical and safe and has a longer service life, a construction mode is simpler and easier to implement than that in the prior art, and the raw materials are common, easily available and low in cost, such that construction cost can be significantly reduced.

BRIEF DESCRIPTION OF DRAWINGS

FIG. 5 is a schematic diagram of a sectional view (i.e. a sectional view of B-B in FIG. 4) of a deck structure in a longitudinal bridge direction according to Embodiment 1; and.

REFERENCE NUMERALS

Figure 1:
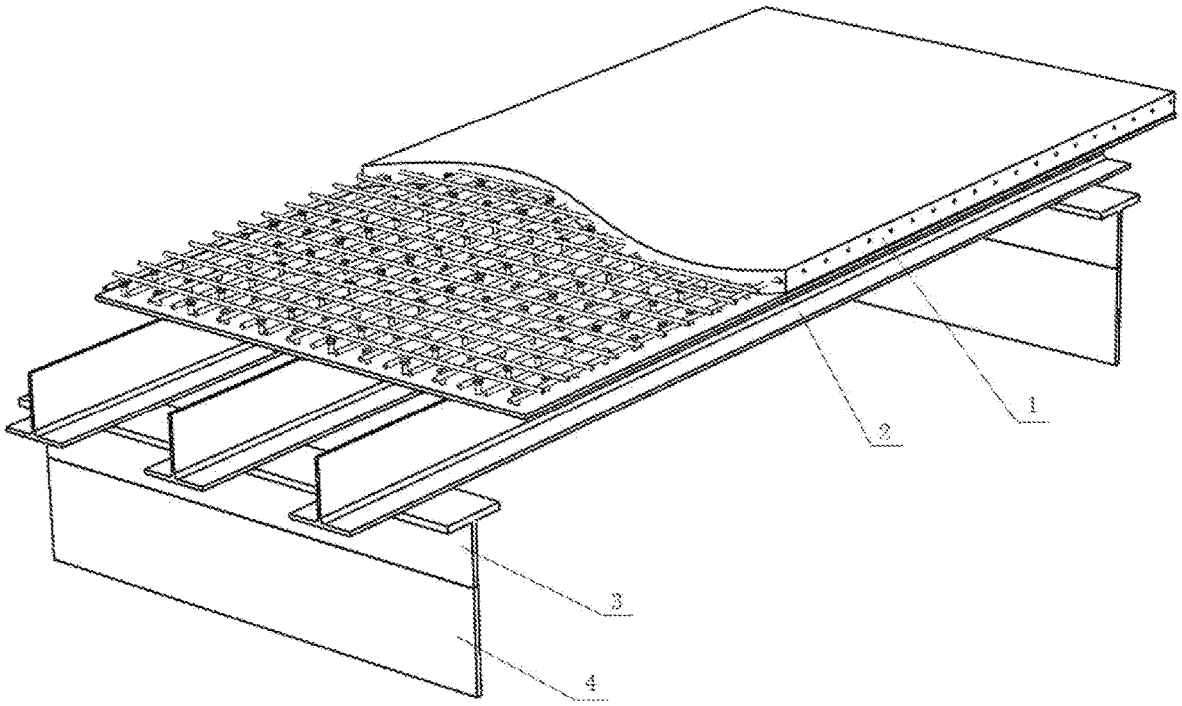
FIG. 1 is a schematic diagram of a three-dimensional structure of a composite deck structure for a bridge according to Embodiment 1.
Figure 2:
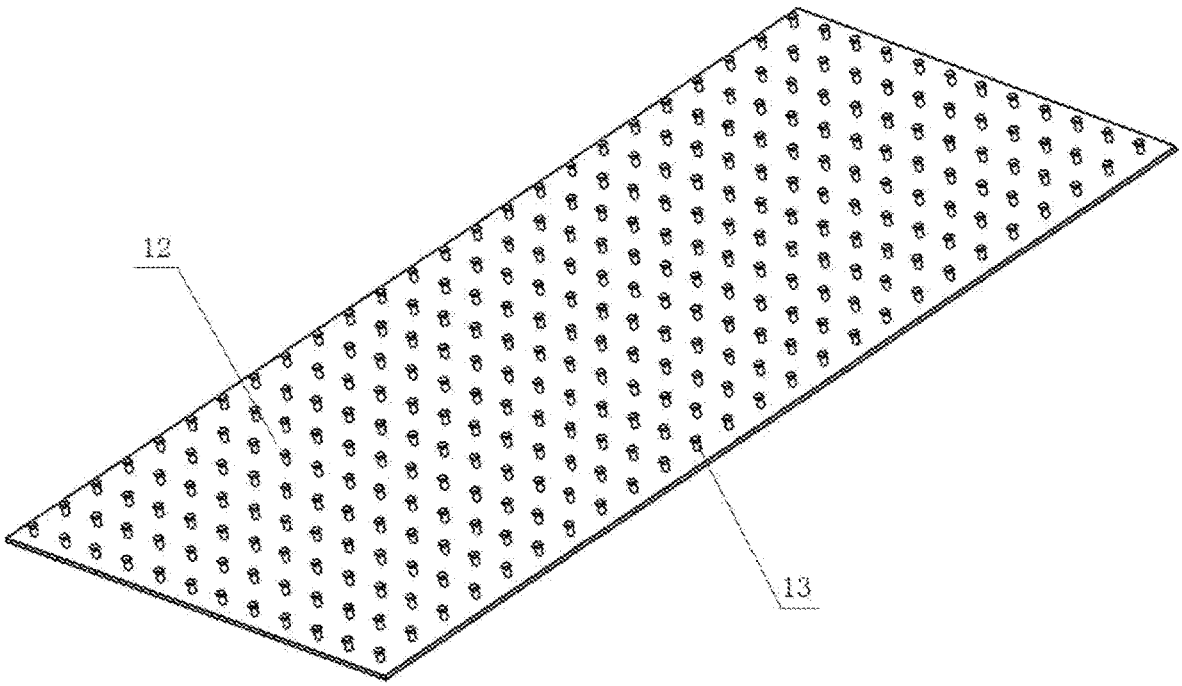
FIG. 2 is a schematic diagram of a steel panel provided with studs through welding according to Embodiment 1.
Figure 3:
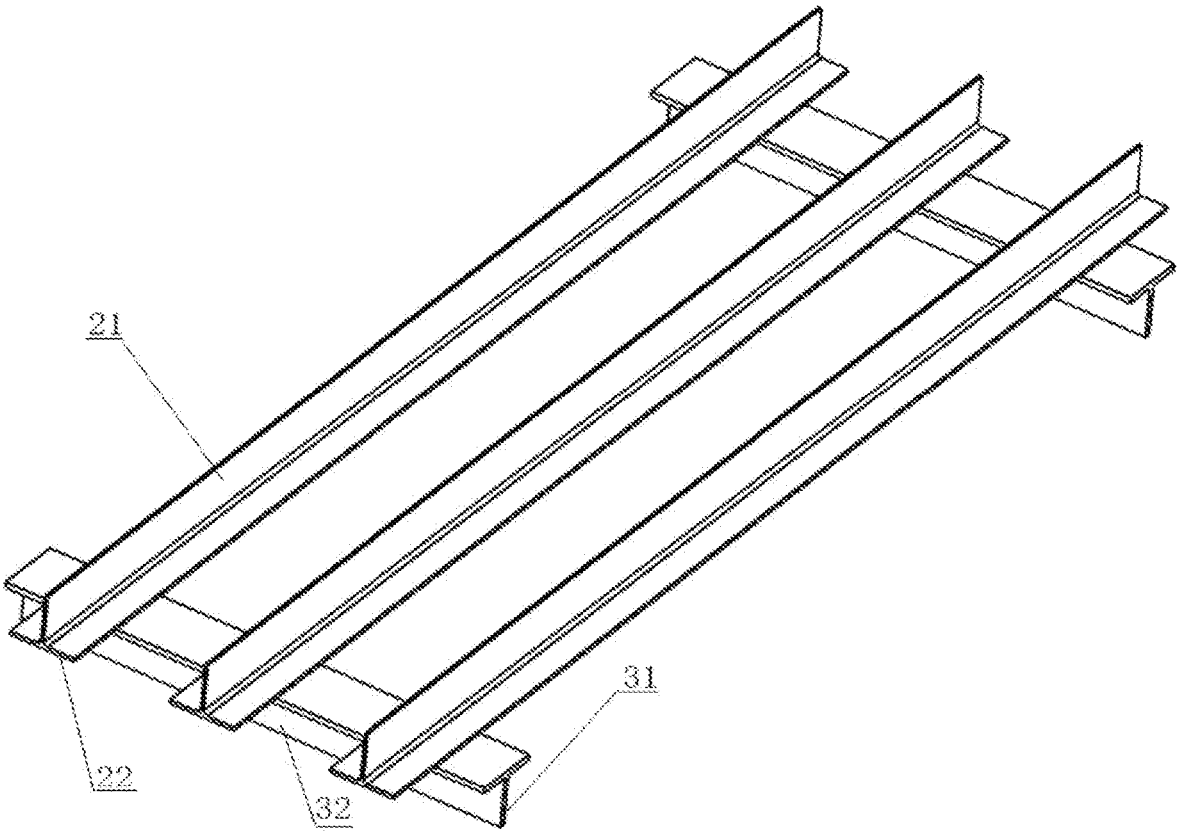
FIG. 3 is a schematic diagram of a connection relation between longitudinal ribs and transverse ribs according to Embodiment 1.
Figure 4:
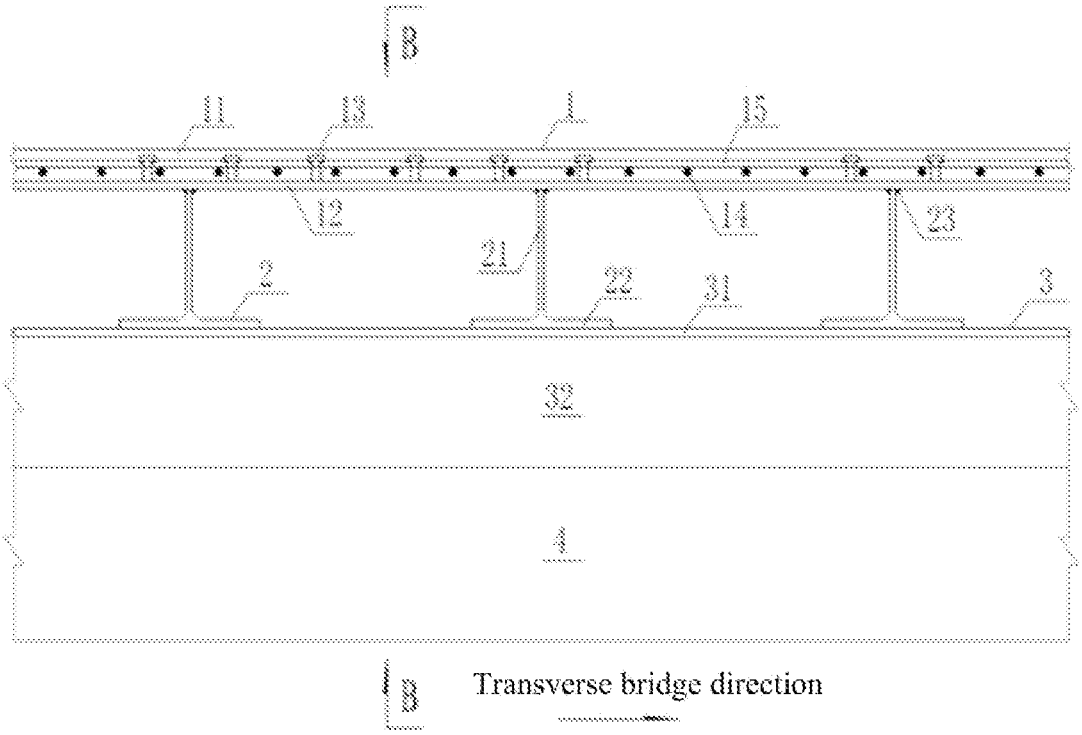
FIG. 4 is a schematic diagram of a sectional view (i.e. a sectional view of A-A in FIG. 5) of a deck structure in a transverse bridge direction according to Embodiment 1.
Figure 5:
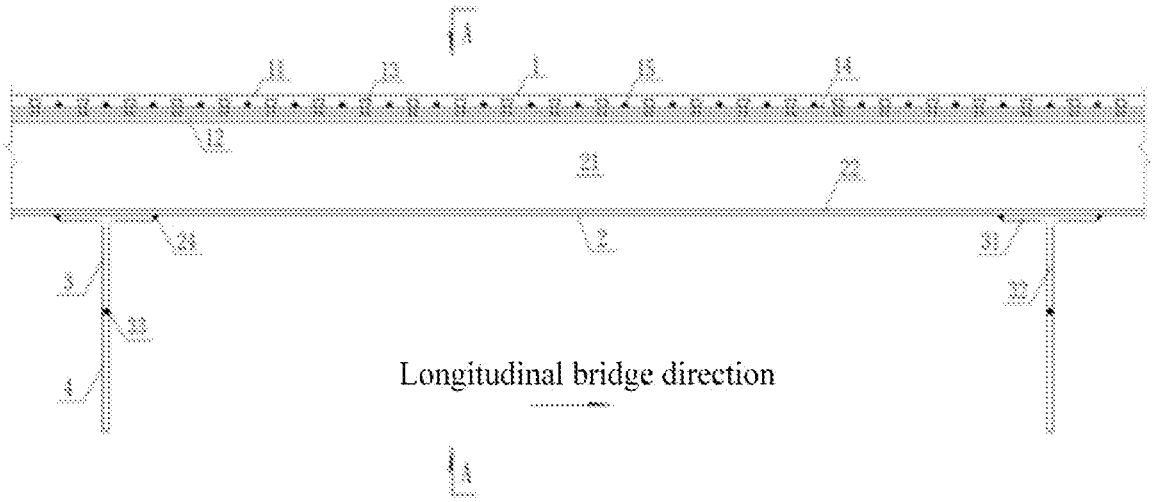

1, top plate; 2, longitudinal rib; 3, transverse rib; 4, diaphragm; 11, ultra-high-performance concrete plate: 12, steel panel; 13, stud; 14, longitudinal steel bar; 15, transverse steel bar; 21, longitudinal web plate: 22, longitudinal flange plate; 23, first type of welding seam; 24, second type of welding seam; 31, transverse flange plate; 32, transverse web plate; 33, third type of welding seam; 5, main beam structure; 6, composite deck structure.

DETAILED DESCRIPTION OF THE EMBODIMENTS

The present disclosure will be described in further detail below with reference to the accompanying drawings and specific embodiments.

EMBODIMENT

As shown in FIGS. 1-5, a composite deck structure for a bridge according to the embodiment includes a top plate 1 and longitudinal ribs 2 fixed to a lower surface of the steel panel 1, and further includes transverse ribs 3 spliced on diaphragms 4 of a main beam structure 5 of a bridge. The longitudinal ribs 2 are fixedly connected to the transverse ribs 3, and are connected to the diaphragms 4 by means of the transverse ribs 3. The transverse ribs 3 and the diaphragms 4 are not provided with cutouts for accommodating and welding the longitudinal ribs 2.

In the embodiment, the longitudinal ribs 2 and the transverse ribs 3 are made of hot-rolled section steel commercially available on the market.

In the embodiment, the longitudinal ribs 2 are located on the transverse ribs 3.

In the embodiment, the longitudinal rib 2 includes a longitudinal web plate 21 and a longitudinal flange plate 22. The transverse rib 3 includes a transverse web plate 32 and a transverse flange plate 31. The longitudinal rib 2 is fixedly connected to the transverse rib 3 by means of contact surfaces of the longitudinal flange plate 22 and the transverse flange plate 31.

In the embodiment, the longitudinal ribs 2 are made of inverted-T-shaped steel, and the transverse ribs 3 are made of T-shaped steel.

In the embodiment, the transverse ribs 3 are consistent with the diaphragms 4 in the main beam structure 5 of the bridge in longitudinal arrangement position and interval. A central axis of the transverse web plate 32 is flush with a central axis of the diaphragm 4 in the main beam structure 5 of the bridge in a vertical direction.

In the embodiment, all dimensional parameters are determined according to conditions of a bridge construction site.

In the embodiment, both the longitudinal flange plate 22 and the transverse flange plate 31 have a width greater than or equal to 100 mm.

In the embodiment, the longitudinal web plate 21 has a thickness greater than or equal to 6 mm. The transverse web plate 32 has a thickness greater than or equal to 8 mm.

In the embodiment, the longitudinal ribs 2 have a height smaller than or equal to 800 mm, and the transverse ribs 3 have a height smaller than or equal to 400 mm.

In the embodiment, the longitudinal ribs 2 are arranged on the lower surface of the top plate 1 at intervals, and an interval between two adjacent longitudinal ribs 2 is 300 mm-800 mm.

In the embodiment, the top plate 1 is a composite plate. The composite plate includes a steel panel 12 and an ultra-high-performance concrete plate 11 poured on a surface of the steel panel 12. The steel panel 12 is a flat plate having a thickness of 6 mm-20 mm. A single layer of criss-crossed reinforced steel mesh is arranged in the ultra-high-performance concrete plate 11. Transverse steel bars 15 are located above longitudinal steel bars 14. The transverse steel bars 15 and the longitudinal steel bars 14 have a diameter of 8 mm-20 mm. An interval between the adjacent longitudinal steel bars 14 and an interval between the adjacent transverse steel bars 15 are both 30 mm-300 mm. The ultra-high-performance concrete plate 11 is made of the ultra-high-performance concrete. The ultra-high-performance concrete refers to concrete containing steel fibers and having compressive strength not smaller than 100 MPa and axial tensile strength not smaller than 7 MPa. The ultra-high-performance concrete plate 11 is a uniform-thickness plate, and has a thickness of 30 mm-100 mm. The steel panel 12 is provided with studs 13. The studs 13 have a diameter of 10 mm-30 mm and a height of 25 mm-65 mm.

In the embodiment, the longitudinal ribs 2 are connected to the steel panel 12 by means of a first type of welding seams 23.

In the embodiment, the longitudinal flange plates 22 are connected to the transverse flange plates 31 by means of a second type of welding seams 24.

In the embodiment, bottoms of the transverse ribs 3 are connected to tops of the diaphragms 4 by means of a third type of welding seams 33.

By analyzing the above structure, it can be known that the first type of welding seams 23 are welding seams between the steel panel 12 and the longitudinal ribs 2, and fatigue details of the welding seams are divided into fatigue details a at the steel panel 12 and fatigue details b at the longitudinal ribs 2; the second type of welding seams 24 are welding seams between the longitudinal flange plates 22 and the transverse flange plates 31, and fatigue details of the welding seams are divided into fatigue details c at the longitudinal ribs 2 and fatigue details d at the transverse ribs 3; fatigue details of the hot-rolled section steel of the longitudinal ribs 2 are divided into fatigue details e at the longitudinal web plates 21 and fatigue details fat the longitudinal flange plates 22; and fatigue details of the hot-rolled section steel of the transverse ribs 3 are divided into fatigue details g at the transverse flange plates 31 and fatigue details h at the transverse web plates 32. Stress of the above fatigue details is compared with a fatigue grade and a constant-amplitude fatigue limit specified in "Specifications for Design of Highway Steel Bridge" JTG D64-2015 (Chinese steel bridge specification), and results are shown in Table 1:

TABLE 1

Fatigue stress analysis results of each position in the embodiment

| Detail position | Steel panel-longitudinal rib welding seam | | Longitudinal rib-transverse rib welding seam | | Longitudinal rib base material | | Transverse rib base material | |
|---|---|---|---|---|---|---|---|---|
| Detail number | a | b | c | d | e | f | g | h |
| Fatigue stress/MPa | 18.7 | 34.6 | 24.2 | 22.5 | 93.7 | 35.2 | 45.6 | 65.3 |
| Fatigue grade ($2 \times 10^6$ times) | 70 | | 55 | | 160 | | | |
| Constant-amplitude fatigue limit ($5 \times 10^6$ times) | 44.8 | | 35.2 | | 102.5 | | | |

In Table 1, a finite element model of the stress of the fatigue details is created according to the embodiment, and fatigue stress under the most unfavorable working condition is obtained by loading a fatigue load in the model. A single-vehicle model specified in "Specifications for Design of Highway Steel Bridge" JTG D64-2015 is used for the fatigue load, with a total weight of 480 kN and a single axle weight of 120 kN.

Therefore, stress at all the fatigue details of the deck structure of the present disclosure is below the constant-amplitude fatigue limit, such that fatigue cracking caused by excessive fatigue stress of materials is effectively avoided. Moreover, if the transverse ribs 3 and the longitudinal ribs 2 are made of welded steel, fatigue stress at welding seams is greater than the constant-amplitude fatigue limit, and does not satisfy specification requirements, such that the longitudinal ribs 2 and the transverse ribs 3 are made of integrally rolled hot-rolled section steel instead of the welded steel.

Figure 6:
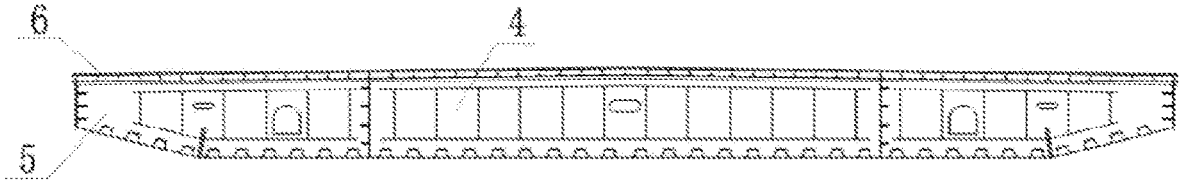
FIG. 6 is a schematic diagram of a sectional view of a bridge structure in a transverse bridge direction according to Embodiment 1.

As shown in FIG. 6, a bridge structure according to the embodiment includes a composite deck structure 6 and a main beam structure 5. The main beam structure 5 is a steel box beam. The main beam structure includes diaphragms 4. The composite deck structure 6 is fixed onto the main beam structure 5. Transverse ribs 3 are spliced on the diaphragms 4 of the main beam structure 5.

In the embodiment, the diaphragms 4 are arranged at intervals in the main beam structure 5, and an interval between two adjacent diaphragms 4 is 2.5 m-8 m.

A construction method of the bridge structure according to the embodiment includes the following steps:

S1, in a factory prefabrication workshop, the steel panel 12 is placed at a bottom layer, and the longitudinal ribs 2 are welded onto the steel panel 12; and steel beam segments including the diaphragms 4 below a deck are also prefabricated in a factory;

S2, the transverse ribs 3 are fixedly connected to the longitudinal ribs 2, so as to form an orthogonal composite deck unit;

S3, after the orthogonal composite deck unit is overturned, the transverse ribs 3 of the orthogonal composite deck unit are correspondingly welded to the diaphragms 4 of the steel beam segments, so as to form main steel beam segments of an entire bridge; and S4, the studs 13 are welded to the steel panel 12 after the main steel beam segments are transported to a bridge construction site and spliced into a full-length main beam segment by segment, a reinforced steel mesh is arranged, and ultra-high-performance concrete is poured on site, so as to finally form a complete bridge structure.

Merely preferred implementation modes of the present disclosure are described above, and the protection scope of the present disclosure is not limited to the above embodiments. Improvements and modifications obtained by those skilled in the art without departing from the technical concept of the present disclosure should be regarded as falling within the scope of the present disclosure.

What is claimed is:

1. A construction method of a bridge structure 1, comprising the following steps:

S1, placing the steel panel (12) at a bottom layer, and welding the longitudinal ribs (2) onto the steel panel (12); and prefabricating steel beam segments comprising the diaphragms (4) below a deck;

S2, fixedly connecting the transverse ribs (3) to the longitudinal ribs (2), so as to form an orthogonal composite deck unit;

S3, overturning the orthogonal composite deck unit, and correspondingly welding the transverse ribs (3) to the diaphragms (4) of the steel beam segments, so as to form main steel beam segments of an entire bridge; and S4, welding the studs (13) to the steel panel (12) after the main steel beam segments are transported to a bridge construction site and spliced into a full-length main beam segment by segment, arranging a reinforced steel mesh, and pouring ultra-high-performance concrete on site, so as to finally form a complete bridge structure;

the bridge structure comprising a composite deck structure (6) and a main beam structure (5), wherein the main beam structure (5) is a steel box beam, a steel truss beam, or a steel plate beam; and the main beam structure (5) comprises diaphragms (4), the composite deck structure (6) is fixed onto the main beam structure (5), and transverse ribs (3) are spliced on the diaphragms (4) of the main beam structure (5);

the composite deck structure for a bridge, comprising a top plate (1) and longitudinal ribs (2) fixed to a lower surface of the top plate (1), and further comprising transverse ribs (3) spliced on diaphragms (4) of a main beam structure (5) of the bridge, wherein the longitudinal ribs (2) are fixedly connected to the transverse ribs (3), and are connected to the diaphragms (4) by means of the transverse ribs (3), and the transverse ribs (3) are not provided with cutouts for accommodating the longitudinal ribs (2).

2. The construction method of a bridge structure according to claim 1, wherein the diaphragms (4) are arranged at intervals in the main beam structure (5), and an interval between two adjacent diaphragms (4) is 2.5 m-8.0 m.

3. The construction method of a bridge structure according to claim 1, wherein the longitudinal ribs (2) and the transverse ribs (3) are made of hot-rolled section steel commercially available on the market.

4. The construction method of a bridge structure according to claim 3, wherein the longitudinal rib (2) comprises a longitudinal web plate (21) and a longitudinal flange plate (22); the transverse rib (3) comprises a transverse web plate (32) and a transverse flange plate (31); and the longitudinal rib (2) is fixedly connected to the transverse rib (3) by means of contact surfaces of the longitudinal flange plate (22) and the transverse flange plate (31).

5. The construction method of a bridge structure according to claim 4, wherein the longitudinal ribs (2) and the transverse ribs (3) are made of one of H-shaped steel, angle steel, I-shaped steel, and T-shaped steel.

6. The construction method of a bridge structure according to claim 4, wherein both the longitudinal flange plate (22) and the transverse flange plate (31) have a width greater than or equal to 100 mm.

7. The construction method of a bridge structure according to claim 4, wherein the longitudinal web plate (21) has a thickness greater than or equal to 6 mm, and the transverse web plate (32) has a thickness greater than or equal to 8 mm.

8. The construction method of a bridge structure according to claim 1, wherein the top plate (1) is a composite plate, and the composite plate comprises a steel panel (12) and an ultra-high-performance concrete plate (11) poured on a surface of the steel panel (12); and the steel panel (12) is provided with studs (13), and the studs (13) each have a diameter of 10 mm-30 mm and a height of 25 mm-65 mm.

* * * * *